US008882574B2

(12) United States Patent
Gilmore

(10) Patent No.: US 8,882,574 B2
(45) Date of Patent: Nov. 11, 2014

(54) GAMING SYSTEM AND METHOD OF PROVIDING AN ELECTRONIC GAME

(75) Inventor: Jason Gilmore, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 67 days.

(21) Appl. No.: 13/565,069

(22) Filed: Aug. 2, 2012

(65) Prior Publication Data

US 2013/0059641 A1 Mar. 7, 2013

(51) Int. Cl.
*G07F 17/32* (2006.01)

(52) U.S. Cl.
USPC ..... 463/16; 463/20; 463/25; 463/29; 463/31

(58) Field of Classification Search
USPC ..... 463/16, 20, 25
IPC ..... G07F 17/32
See application file for complete search history.

(56) References Cited

U.S. PATENT DOCUMENTS

2004/0224745 A1* 11/2004 Bregenzer ..... 463/16
2008/0146314 A1* 6/2008 Yoshizawa ..... 463/20
2009/0203420 A1 8/2009 Yoshizawa
2009/0325668 A1* 12/2009 Kelly et al. ..... 463/20

OTHER PUBLICATIONS

Examiner's First Report for AU Pat. Appln. No. 2011218760 (dated Feb. 16, 2012).

* cited by examiner

*Primary Examiner* — Omkar Deodhar
(74) *Attorney, Agent, or Firm* — Howard & Howard Attorneys PLLC

(57) ABSTRACT

A gaming machine and a method provide primary and secondary games. The gaming machine includes first and second adjacent displays, a lighting device, and a controller. The lighting device is located between the first and second displays. The controller is coupled to the first and second displays and the lighting device. The primary game is played and if a triggering conditioning occurred in the primary game, the secondary game is initiated. The secondary game includes a rotating selector device. A first portion of the rotating selector device is displayed on the first display and a second portion of the rotating selector device is displayed on the second display. The lighting device defines a selector. An outcome of the secondary game is randomly selected and the rotating selector device is rotated and stopped such that the selector is associated with a symbol associated with the outcome of the secondary game.

30 Claims, 4 Drawing Sheets

GAMING SYSTEM AND METHOD OF PROVIDING AN ELECTRONIC GAME

CROSS-REFERENCE TO RELATED APPLICATION

This application claims the benefit of Australian Patent Application No. 2011218760, filed on Sep. 5, 2011, the entire disclosure of which is incorporated by reference herein.

FIELD OF THE INVENTION

The present invention relates generally to video gaming machines and more particularly, to an apparatus and method for providing a bonus or secondary game on a gaming machine.

BACKGROUND OF THE INVENTION

Gaming machines, such as slot machines, are a cornerstone of the gaming industry. Generally, the popularity of such machines with players is dependent on the perceived likelihood of winning money at the particular game and the intrinsic entertainment value of the game relative to other available gaming options. Where the available gaming options include a number of competing games and the expectation of winning each game is believed to be generally the same, players are most likely to be attracted to the most entertaining and exciting games. Thus, gaming operators strive to employ the most entertaining and exciting games available because such games attract frequent play and, hence, increase profitability to the operator.

Furthermore, one concept that has been successfully employed to enhance the entertainment value of the game is the addition of a bonus game that may be played in conjunction with the "primary" game. The bonus game may comprise any type of game, either similar to or completely different from the primary game. The bonus game is initiated upon the occurrence of a selected event or outcome of the primary game.

Because the excitement and entertainment value of the primary game provides increased player appeal relative to other gaming machines and the bonus game concept increases player appeal and excitement, thereby increasing the chance to win the potential pay-out amount, there is a continuing need to develop new features for primary and bonus games. New features are necessary to appeal to player interest and enhance excitement in order to entice longer play and satisfy demands of operators for interesting games and increased profitability.

The present invention is directed to satisfying these needs.

SUMMARY OF THE INVENTION

In a first aspect of the present invention, a method provides primary and secondary games to players. The method includes the step of providing a gaming machine including first and second displays and a lighting device located between the first and second displays. The first and second displays being adjacent. The method also includes the steps of allowing an associated player to make a wager on a primary game, randomly selecting an outcome of the primary game, determining if the outcome of the primary game is a winning outcome, and awarding the associated player a primary award as a function of the outcome, the wager made by the player, and a predetermined paytable. The method includes the step of determining if a triggering conditioning occurred in the primary game and initiating a secondary game. The secondary game includes a rotating selector device. A first portion of the rotating selector device is displayed on the first display and a second portion of the rotating selector device is displayed on the second display. The lighting device defines selector. For the secondary game, the controller randomly selects an outcome of the secondary game, rotates the rotating selector device, controllably stops the rotating selector device such that the selector is associated with a symbol associated with the outcome of the secondary game, and awards one or more of the players a secondary award as a function of the outcome of the secondary game.

In a second aspect of the present invention, a gaming machine is provided. The gaming machine includes first and second displays, a lighting device, and a controller. The first and second displays are adjacent. The lighting device is located between the first and second displays. The controller is coupled to the first and second displays and the lighting device. The controller allows an associated player to make a wager on a primary game, randomly selects an outcome of the primary game, determines if the outcome of the primary game is a winning outcome, and awarding the associated player a primary award as a function of the outcome, the wager made by the player, and a predetermined paytable. The controller also determines if a triggering conditioning occurred in the primary game and initiates a secondary game. The secondary game includes a rotating selector device. A first portion of the rotating selector device is displayed on the first display and a second portion of the rotating selector device is displayed on the second display. The lighting device defines a selector. The controller further randomly selects an outcome of the secondary game, rotates the rotating selector device, controllably stops the rotating selector device such that the selector is associated with a symbol associated with the outcome of the secondary game, and awards one or more of the players a secondary award as a function of the outcome of the secondary game.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

With reference to the drawings and in operation, the present invention provides a gaming system 10 which provides a primary (or base) game and a secondary game to players on one or more gaming machines 14.

In one embodiment, the secondary game is provided on a single gaming machine 14.

In another embodiment, the secondary game is provided on a plurality of linked gaming machines 14. The secondary game may be a progressive game. Progressive games are well known in the art and are therefore not further discussed.

Figure 2A:
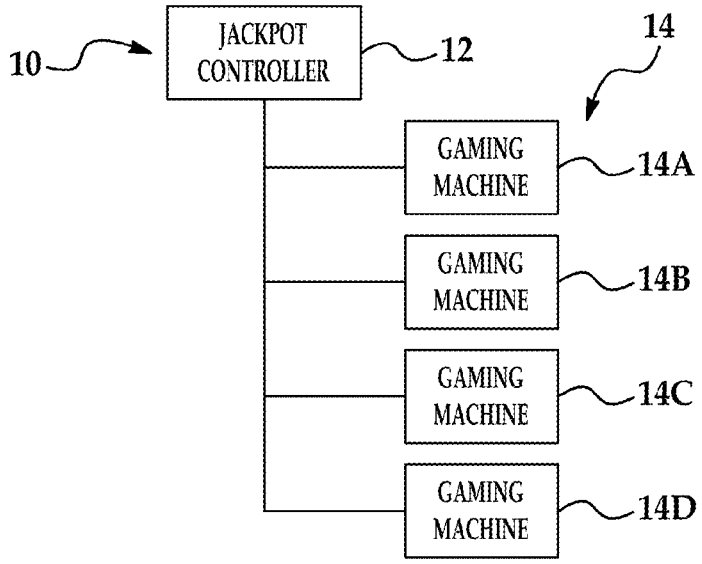
FIG. 2A is a diagram of a system for providing electronic games, according to an embodiment of the present invention.
Figure 3:
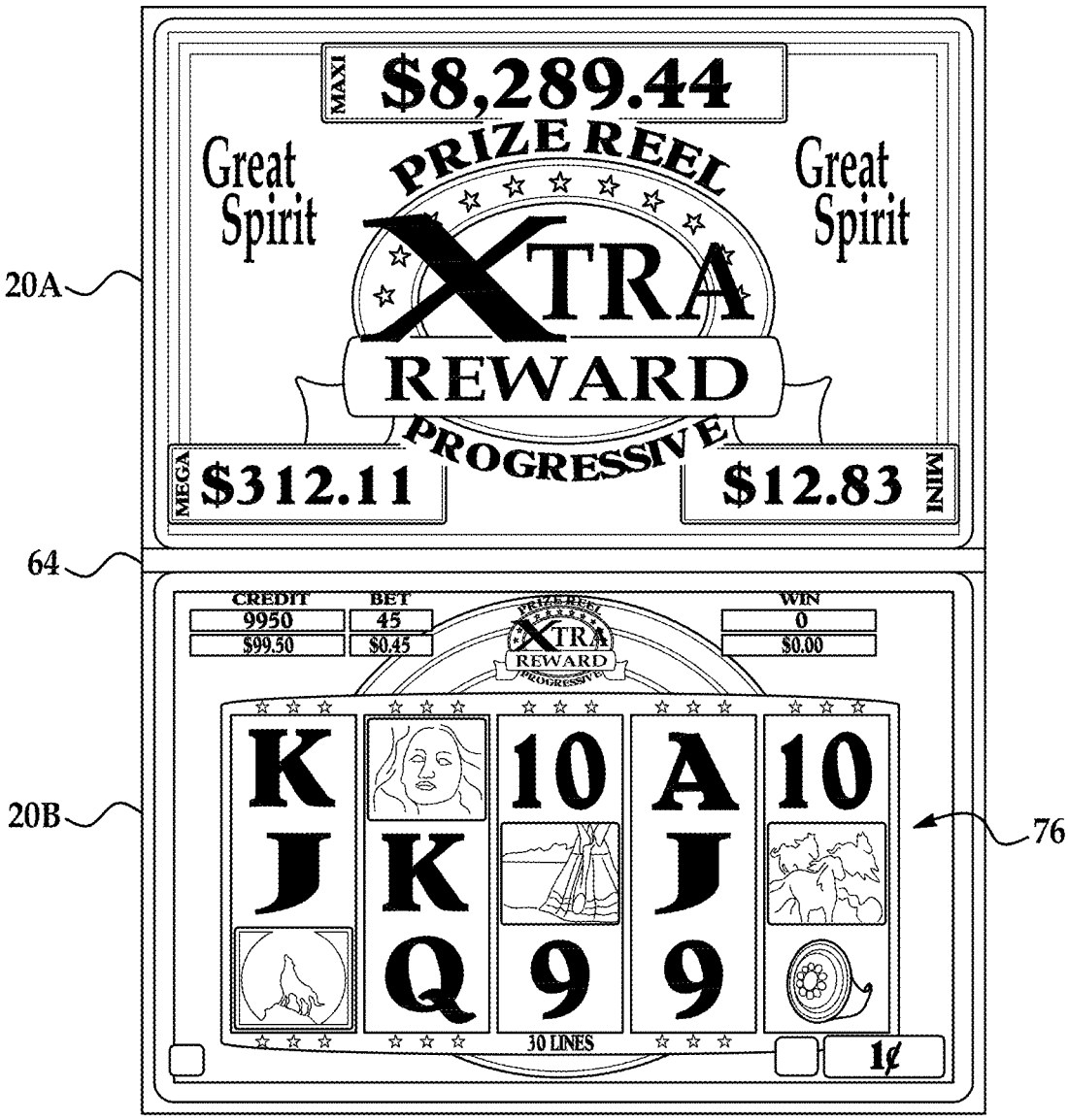

With specific reference to FIG. 2A, in one embodiment, the system 10 includes a jackpot controller 12 and a plurality of gaming machines 14. In the illustrated embodiment, the system 10 includes four gaming machines 14A, 14B, 14C, 14D, which in one embodiment as shown in FIG. 3 are arranged in a bank, i.e., are arranged together, adjacently. It should be noted, however, that the gaming machines 14 may include any number of gaming machines 14, and may be arranged in any manner, such as in a circle or along a curved arc. Furthermore, additional groups of gaming machines 14 may be coupled to the jackpot controller 12.

It should also be noted that the secondary game may be provided and controlled by one of the gaming machines 14.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

A preferred embodiment of the present invention is a video gaming machine preferably installed in a casino.

Figure 1:
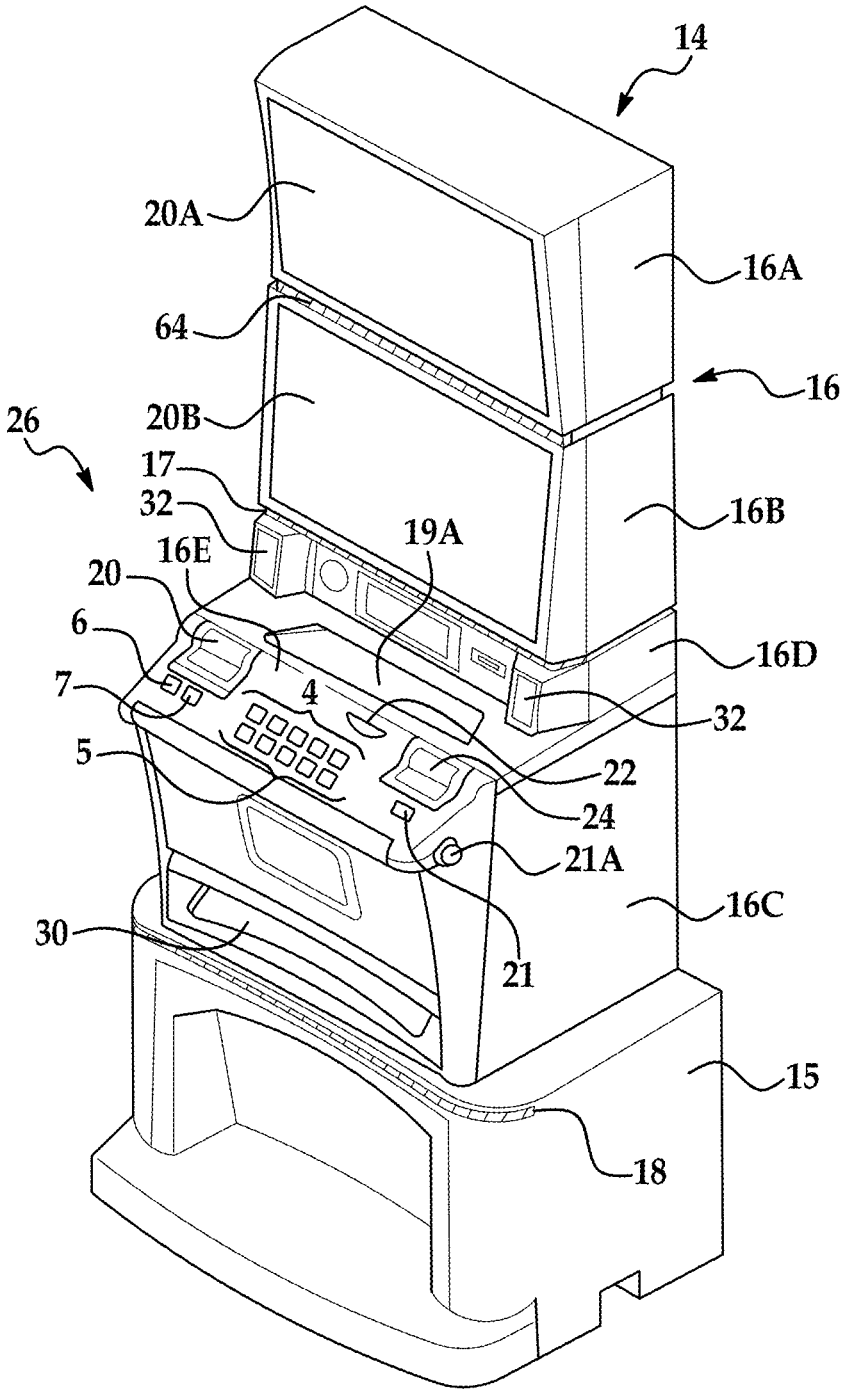
FIG. 1 is a perspective view of a gaming machine.

Referring to FIG. 1, in the illustrated embodiment, each gaming machine 14 comprises a box-shaped modular cabinet 16. One such cabinet is disclosed in commonly owned US Patent Application Publication 20100087259 (Ser. No. 12/287,428), filed Oct. 8, 2008, which is hereby incorporated by reference.

The gaming machine 14 has a modular structure for a video gaming machine of an embodiment of the present invention. The gaming machine 14 is configured by a first cabinet 16A including a display 20A; a second cabinet 16B including a second display 20B, a third cabinet 16C including input devices for playing the game and a fourth cabinet 16D including a controller for controlling each section of the gaming machine 14. The gaming machine 14 is generally set up on a game stand 15 depending on a situation where the gaming machine 14 is setup.

As shown in FIG. 1, a part of the top surface of the third cabinet 16C facing to the player is designed to be slanted downward so that the player can easily operate input buttons and input devices 26 for the games displayed on the first display 20A and/or the second display 20B. With respect to the input buttons 26, there are provided BET switches 4, selection switches 5, a MAXBET switch 6 a PAYOUT switch 7, start buttons 21 and 21A. With respect to the input devices, there are provided a coin slot 22 and a bill acceptor 24. The BET switches 4 include five switches from 1 BET to 5 BET. The selection switches 5 include five switches from 1 (one) select to 5 (five) selects of bet lines. A coin tray 30 is provided in the lower part of the third cabinet 16C. Further, there is provided an output device, for example, a printer 20 on a slanted surface 16E of the third cabinet 16C for outputting printed material pertaining to the game of the gaming machine 14.

The instruction for performing a primary game or a secondary game is normally displayed on the first display 20A. Indicia or symbols for use in the primary game, e.g., cards used by a card game, roulette used in a roulette game and reels used in a reel game, are displayed on the second display 20B.

The BET switches 4 are switches for inputting a bet on the game. The player can input a bet from 1 BET to 5 BET using the BET switches 4 one time for a game. A selection switch 5 is a switch for, for example, selecting a line on the reels and the card, which the player wants to set on the games.

The MAXBET switch 6 is a switch for inputting the maximum bet that a player can spend against one time of a game. The PAYOUT switch 7 is a switch for rewarding the amount of money to a player, which has been credited onto the gaming machine. The start buttons 21, 21A are buttons for starting game. The starting buttons 21, 21A may be arranged on the slanted surface 16E of the third cabinet 16C and sidewall of the third cabinet 16C so that the player can select the starting button for his or her preference in this embodiment. A coin slot 22 is a hole for a player to insert the coin to the gaming machine 14. A bill acceptor 24 is a input and output device to be used in order to feed a bill or a cash card into the gaming machine, or in order to repay the amount of money, which has been credited.

As is known in the art, the first and second displays 20A, 20B may be touchscreens to implement a portion of a user interface.

In one embodiment the displays 20A, 20B each include a flat panel display, such as an LCD, LED, plasma, or other suitable display.

In particular, the second display 20B displays a game screen, see for example, FIG. 3. The primary game is displayed on the game screen. The primary game may be any type of game, including, but not limited to a video slot game, a keno game, a blackjack game, a video poker game, or any type of game which allows a player to make a wager, plays a game, and potentially provides the player an award based on an outcome of the game and a paytable.

One or more speakers 32 are installed inside the cabinet 16, and generates voice announcements and sound effects during game play.

Figure 2B:
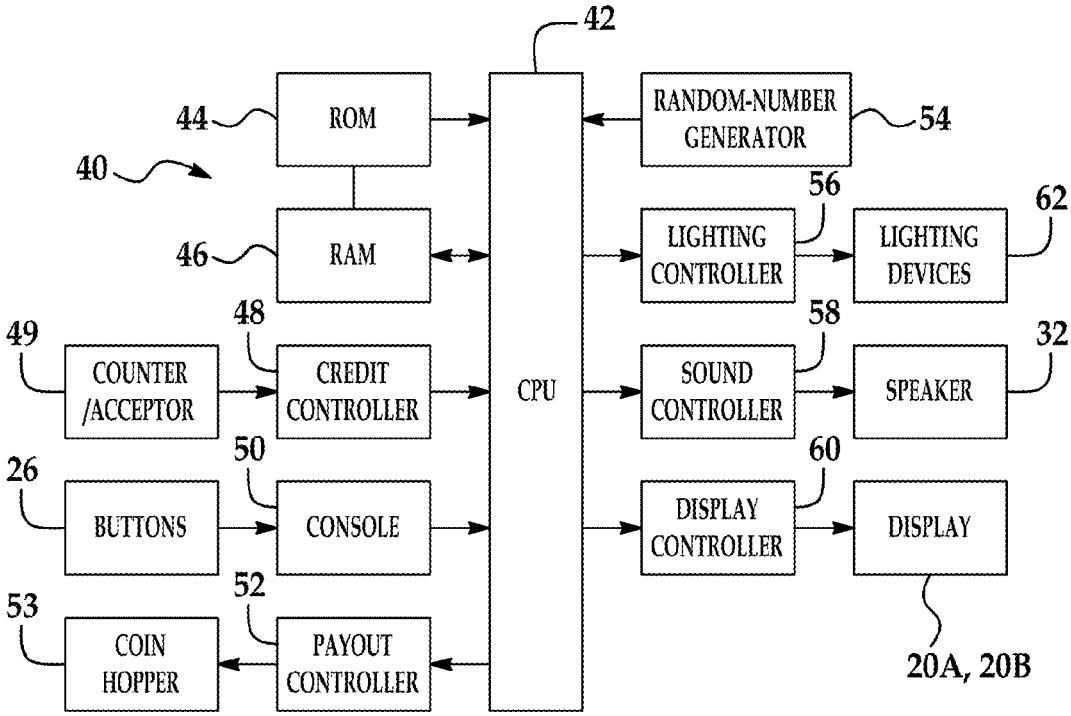
FIG. 2B is a schematic representation of the video gaming machine of the present invention; and, FIG. 3 is a diagrammatic illustration of a screen shot of primary game, according to an embodiment of the present invention.

With specific reference to FIGS. 2A and 2B, in the illustrated embodiment, each gaming machine 14 is controlled by a game controller 40. In one embodiment, the game controller 40 is within the cabinet 14. Alternatively, the game controller 40 may be separated from the cabinet 16, and connected through a network to the components of the cabinet 16.

In one embodiment, the jackpot controller 12 may be implemented by one of the game controllers 40. In still another embodiment, a single controller (not shown) which may be located remotely or within one of the cabinets 16 may perform all of the functions of the game controllers 40 for each gaming machine and the jackpot controller 12.

In the illustrated embodiment, the game controller 40 includes a CPU 42, a ROM 44, a RAM 46, a credit controller 48, a console unit 50, a payout controller 52, a random-number generator 54, a lighting controller 56, a sound controller 58, and a display controller 60.

The CPU 42 executes various programs, and thereby controls other components of the game controller 40 according to instructions and data accepted by the console unit 48. The CPU 42 in particular executes a game program, and thereby conducts a game having normal and bonus modes. The ROM 44 stores programs and databases used by the CPU 42. The ROM 44 in particular stores image data for producing two game images and screens on the displays 20A, 20B. The RAM 46 temporarily stores variables, parameters, and the like that are used by the CPU 42.

The credit controller 48 manages the amount of player's credits, which is equivalent to the amount of coins and bills counted and validated by the counter/acceptor 49. The console unit 50 monitors the input buttons 26 and accepts various instructions and data that a player enters through the input buttons 26. The payout controller 52 changes player's credits to coins, bills, or other monetary data by using the coin tray 30 or the like.

The random-number generator (RNG) 54 generates and outputs random numbers to the CPU 42 preferably at the start of each round of game. The CPU 42 uses the random numbers to determine an outcome of the primary and secondary games.

For example, if the primary game is a video slot game, the CPU 42 uses the RNG 54 to randomly select an arrangement of symbols to be displayed on the video reels.

The CPU 42 generally uses the random numbers to play the primary and secondary games and to determine whether or not to provide an award to a player at random in the following manner. The CPU 42 retrieves the random numbers from a winning combination table stored in the ROM 44. The winning combination table represents relationship between combinations of random numbers and types of awards.

The lighting controller 56 controls one or more lighting devices 62. The lighting controller 56 thereby causes the lighting devices 62 to blink and/or change brightness and color in specific patterns in order to produces lighting effects. In one embodiment, the lighting devices 62 include light devices 17, 18 and a Podium payline light 64

The Podium payline light 64 which is, as shown in FIG. 1, located between the first and second displays 20A, 20B. As discussed more fully below, in the secondary game 70, the first and second displays 20A, 20B, and the Podium payline light 64 is utilized as a large rotating selector device 72, the Podium payline light 64 serving as the selector 74. As discussed more fully below, in one embodiment, the rotating selector device 72 is a large reel 72A which rotates vertically (see FIGS. 4 and 5). In a second embodiment, the rotating selector device 72 is a wheel 72B. It should be noted that other designs of the rotating selector device 72 may be used without departing from the spirit of the invention.

The sound controller 58 controls the speakers 32 to output voice announcements and sound effects during game play.

The display controller 60 controls the displays 20A, 20B to display various images on screens preferably by using computer graphics and image data stored in the ROM 44. The display controller 60 in particular controls video reels in a game screen displayed on the second display 20B by using computer graphics and the image data.

The display controller 60 further controls video reels in different manners depending on whether a round of game is in a normal or bonus mode.

It should be noted that the above described gaming machine 14 is for exemplary purposes only. The present invention is not limited to any particular gaming machine 14 and/or game. The gaming machine 14 may also include other features. For example, the gaming machine 14 may include a player tracking device (not shown) which is connected to a player tracking system. The gaming machine 14 may also utilize a cashless wagering system (not shown), such as a ticket in ticket out (TITO) system (not shown) and may include a player tracking device (not shown).

The game controller 40 awards a regular payout in response to the outcome of the primary game.

The game controller 40 displays the primary game on the display 20A. In one embodiment, the primary game 76 is a video slot game, as show in FIG. 3. However, it should be noted that the primary game could be any type of game upon which a player could make a wager.

For example, in the case where the primary game is a video slot game, the primary game includes a plurality of elements in a grid having a plurality of cells defined by rows and/or columns. During play of the video slot game, the game controller 40 randomly selects the game elements to be displayed in the second display device 20B. The selected game elements are selected from a set of possible game elements. The game controller 40 is adapted to determine an outcome of each of the game based on the displayed game elements, the paytable, a wager, and predetermined paylines.

Each video slot game is generally first played in a conventional manner. The player makes a wager, which may be based on a predetermined denomination and a selected number of paylines. The reels are spun and game symbols or elements are randomly chosen for each cell. If a predetermined pattern of elements are randomly chosen for each cell on a played payline, the player is awarded a payout based on the payline, the wager, and a predetermined paytable. Many variations to the above described general play of a video slot game fall within the scope of the present invention. Such video slot games are well-known in the art, and are therefore not further discussed.

After the outcome of the primary game is determined, a triggering condition may be detected. If the triggering condition is detected then the secondary game is initiated.

In one aspect of the present invention, the secondary game is a progressive game in which multiple players may be eligible in to win a, generally large, jackpot or payout. The jackpot or payout is generally funded from a pool which is added to through contributions from the wagers made by a plurality of players. The triggering condition for the progressive award may be the appearance of a triggering symbol within the primary game of one the gaming machines 14, or may be based on a separate random event. The triggering condition may be determined at the jackpot controller 12 or the game controller 40. The triggering condition for one embodiment of the progressive game is discussed more fully below.

Alternatively, the secondary game is a bonus game in which only the player who has triggered the secondary game may win and the secondary jackpot or bonus is funded from the associated gaming machine 14. With respect to the bonus game, a plurality of the gaming machines 14 may be used to display the bonus game so that all of the players may share in the excitement of the bonus game. In one embodiment, the triggering condition is winning outcome condition. For example, in FIG. 3, if the primary game has a winning condition, then the bonus award would be awarded in addition to the award for the winning condition of the primary game. Alternatively, the triggering condition could be a losing outcome.

With specific reference to FIGS. 2-3, in one embodiment, the gaming system 10 includes a plurality of linked gaming machines 14 and a jackpot controller 12. Each gaming machine 14 includes display 20 and a game controller 40. The controller 40 allows an associated player to make a wager on a primary game, randomly selects an outcome of the primary game and determines if the outcome of the primary game is a winning outcome. If the outcome of the primary game is a winning outcome, the controller 40 awards the associated player a primary award as a function of the outcome, the wager made by the player, and a predetermined paytable.

The jackpot controller 12 determines if a triggering conditioning occurred in one of the primary games and initiates the secondary game 70. The outcome of the secondary game 70 is displayed using a rotating selector device 72.

The jackpot controller 12 randomly selects an outcome of the secondary game, spins rotating selector device 72, and awards one or more of the players a secondary award as a function of the outcome of the secondary game 70.

As discussed more fully below, in one embodiment the secondary game 70 is a progressive game. The secondary award may be either a set amount or a progressive award or amount. In one embodiment the progressive award may be one of a plurality of progressive award levels.

In the illustrated embodiment, the display 20 on each gaming machine 14 includes a first display 20A and a second display 20B. Generally, the primary game is displayed on the second display 20B and the secondary game, the rotating selector device 72 uses both the first and second displays 20A, 20B. In this embodiment, a first portion of each video reel is displayed on the first display device 20A of the associated gaming machine and a second portion of each video reel being displayed on the second display device of the associated gaming machine.

With reference to the drawings, and in operation, the present invention provides a method and gaming system/machine 10, 14 which provides primary and secondary games to one or more players. As discussed above, each gaming machine 14 includes a game controller 40. The game controller 40 controls the primary game 76. The game controller 40 may also control the secondary game 70. Alternatively, the jackpot controller 12 may control the secondary game 70. In the discussion below, the term "controller" may refer to the (a) game controller 40 or (b) the game controller 40 and the jackpot controller 12.

The controller 12, 40 is coupled to the first and second displays 20A, 20B and the lighting device 64. In general, the controller 12, 40, controls the primary game by allowing an associated player to make a wager on the primary game, randomly selecting an outcome of the primary game, determining if the outcome of the primary game is a winning outcome, and awarding the associated player a primary award as a function of the outcome, the wager made by the player, and a predetermined paytable. The controller 12, 40 determines if a triggering conditioning occurred in the primary game and responsively initiates the secondary game 70. The secondary game 70 including a rotating selector device 72. A first portion of the rotating selector device 72 is displayed on the first display 20A and a second portion of the rotating selector 72 device is displayed on the second display 20B. The lighting device 64 defines a selector 74. The controller 12, 40 in playing the secondary game, randomly selects an outcome of the secondary game 70, rotates the rotating selector device 72, controllably stops the rotating selector device 72 such that the selector 74 is associated with a symbol associated with the outcome of the secondary game, and awards one or more of the players a secondary award as a function of the outcome of the secondary game.

As discussed above, the secondary game may be a progressive game. The outcome of the secondary game may be a set amount, free spins and/or a progressive award. In one embodiment, the progressive game may have multiple award levels, with an increasing potential award.

Figure 4:
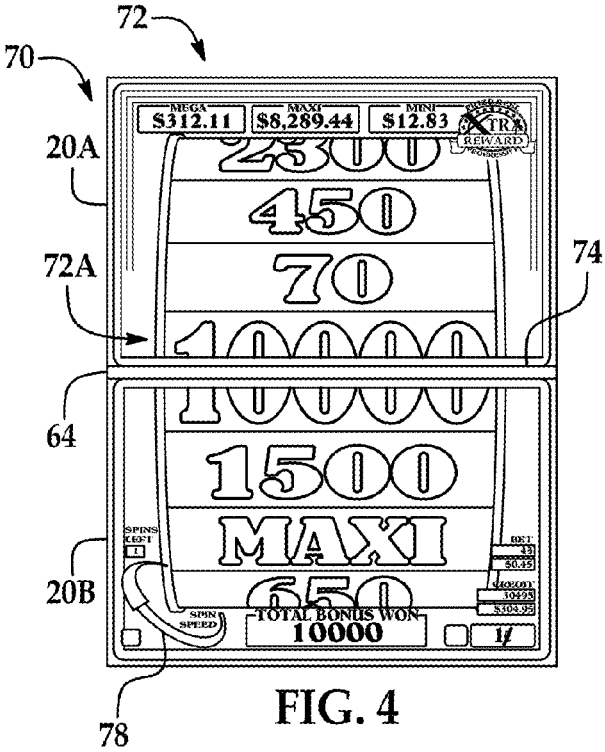
FIG. 4 is a diagrammatic illustration of a screen shot of secondary game including a rotating selector device, according to an embodiment of the present invention.
Figure 5:
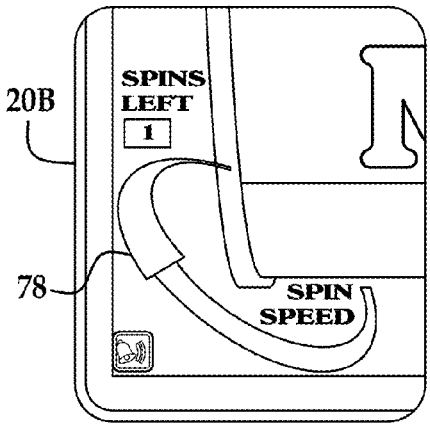
FIG. 5 is an enlarged portion of the screen shot of FIG. 4.
Figure 6:
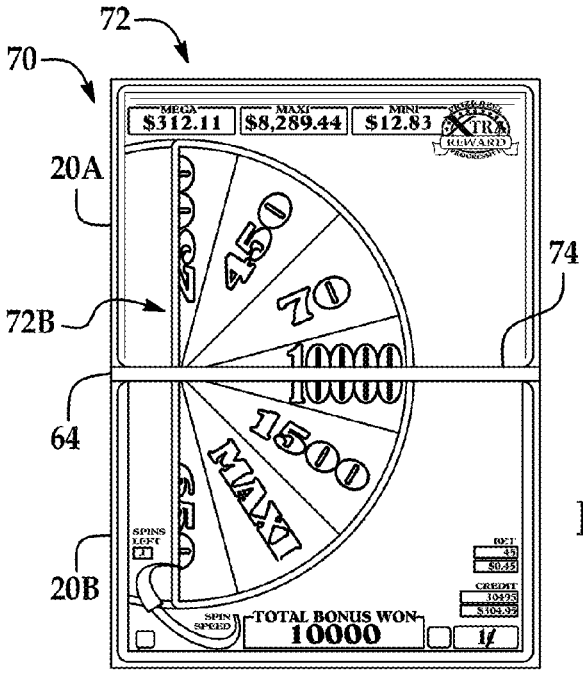
FIG. 6 is a diagrammatic illustration of a screen shot of secondary game including a rotating selector device, according to another embodiment of the present invention.

With respect to FIGS. 3-5, in one embodiment, an implementation called "Xtra Reward Prize Reel Progressive" is shown. The premise behind Xtra Reward entails players spinning a giant prize reel 72A that occupies both the top and bottom displays 20A, 20B. The Podium lighting 64 is used as a "payline" or selector 74. As shown in FIG. 4, the giant reel 72A displays multiple symbols, which may correspond to a set amount, e.g., in credits, a progressive award level, or free spins. It should be noted that the reel 72 may not include every type of award or may include other types of awards. When the secondary game 70 ends, i.e., the reel 72A ends, whatever value (symbol) stops on the payline (and hence the top and bottom screen simultaneously) is awarded to the player. Credit values, free games, and the progressive prize would be the viable outcomes for the reel.

In one embodiment, the Xtra Reward bet is a forced bet, i.e., the player must pay an additional wager. Having triggering symbols on the reels would be another advantage of making this a "forced bet".

In one embodiment, the hit rate for this feature would be quite frequent—roughly every 40-50 spins. The secondary game may be triggered by the appearance of a the number of trigger symbols in the outcome of the primary game. The number of spins the player would get on the rotating selector device 72 would be determined by the number of trigger symbols. For example, three scattered trigger symbols may award 1 spin, four symbols may award 2 spins, and 5 trigger symbols may award 3 spins on the rotating selector device 72.

In one embodiment, the distribution of these events happening could be roughly 75%, 15% (20%), 10% (5%), respectively.

Prizes on the reel may range from the large progressive amount (starting at $7500), a middle progressive (starting at $250), a small progressive amount (starting at $5.00), 10 free games, and credit awards (from 50 to 10,000 credits).

In one embodiment, when triggered, players would be allowed to initiate the real time 3D spinning reel 72 via the button panel. A power meter 78 resides at the side of the reel. The power meter 78 would represent how fast or slow the reel would spin and would cycle back and forth from weak to powerful. When players feel ready, the player may press the hardware button to initiate the reel spin.

Since the reel in the secondary game takes up a large portion of both the top and bottom screens 20A, 20B, realistically, the rotating selector device 72 may not be shown during a base game 76. In one aspect a frequent attract mode may be used, where players walking by the gaming machine 14 can see the rotating selector device 72. When the game is in an idle state, or non-bonus mode, players will be able to see the three progressive values, the game title, and the Prize Reel Progressive Xtra Reward title on the first display 20A (see FIG. 3).

Other aspect and features of the present invention can be obtained from a study of the drawings, the disclosure, and the appended claims.

What is claimed is:

1. A method of providing primary and secondary games to players, including the steps of:

providing a gaming machine including first and second displays and a lighting device located between the first and second displays, the first and second displays being adjacent;

allowing an associated player to make a wager on a primary game;

randomly selecting an outcome of the primary game;

determining if the outcome of the primary game is a winning outcome; and, awarding the associated player a primary award as a function of the outcome, the wager made by the player, and a predetermined paytable; and, determining if a triggering conditioning occurred in the primary game and initiating a secondary game, the secondary game including a rotating selector device, a first portion of the rotating selector device being displayed on the first display and a second portion of the rotating selector device being displayed on the second display, the lighting device defining a selector, for the secondary game:

randomly selecting an outcome of the secondary game;

rotating the rotating selector device, the rotating selector device being configured to display a series of symbols in a cycling manner across the first display to the second display such that each symbol moves from the first display to the second display and during the movement from the first display to the second display each symbol appears, in part, on the first display and the second display;

controllably stopping the rotating selector device such that a portion of one of the symbols is displayed on the first display and another portion of the one of the symbols is displayed on the second display, the portions of the one of the symbols forming a unified image, the unified image being positioned such that the unified image is overlapped by the selector, the one of the symbols being associated with the outcome of the secondary game; and, awarding one or more of the players a secondary award as a function of the outcome of the secondary game.

2. A method, as set forth in claim 1, wherein the rotating selector device is a reel.

3. A method, as set forth in claim 1, wherein the rotating selector device is a spinner.

4. A method, as set forth in claim 1, the secondary game being a progressive game.

5. A method, as set forth in claim 4, the outcome of the secondary game being one of a set amount and a progressive award.

6. A method, as set forth in claim 5, the progressive award being one of a plurality of progressive award levels.

7. A method, as set forth in claim 4, the outcome of the secondary game being one of a set amount, a progressive award, and a number of free spins.

8. A method, as set forth in claim 1, wherein qualification for the secondary game requires an additional wager.

9. A method, as set forth in claim 1, the secondary award being a function of a multiplier.

10. A method, as set forth in claim 1, wherein the primary game is a video slot game.

11. A method, as set forth in claim 10, the triggering condition being the appearance of one or more triggering symbols in the outcome of the primary game.

12. A method, as set forth in claim 1, the secondary game including a number of spins of the rotating selector device.

13. A method, as set forth in claim 12, wherein the number of spins is one of fixed and variable.

14. A method of providing primary and secondary games to players, including the steps of:

providing a gaming machine including first and second displays and a lighting device located between the first and second displays, the first and second displays being adjacent;

allowing an associated player to make a wager on a primary game;

randomly selecting an outcome of the primary game;

determining if the outcome of the primary game is a winning outcome; and, awarding the associated player a primary award as a function of the outcome, the wager made by the player, and a predetermined paytable; and, determining if a triggering conditioning occurred in the primary game and initiating a secondary game, the secondary game including a rotating selector device, a first portion of the rotating selector device being displayed on the first display and a second portion of the rotating selector device being displayed on the second display, the lighting device defining a selector, for the secondary game:

randomly selecting an outcome of the secondary game;

rotating the rotating selector device;

controllably stopping the rotating selector device such that the selector is associated with a symbol associated with the outcome of the secondary game; and, awarding one or more of the players a secondary award as a function of the outcome of the secondary game, the secondary game including a number of spins of the rotating selector device, the triggering condition being the appearance of one or more triggering symbols in the outcome of the primary game, the number of spins of the rotating selector device being equal to the number of triggering symbols.

15. A gaming machine, comprising:

first and second displays, the first and second displays being adjacent;

a lighting device located between the first and second displays;

a controller coupled to the first and second displays and the lighting device, the controller for allowing an associated player to make a wager on a primary game, randomly selecting an outcome of the primary game, determining if the outcome of the primary game is a winning outcome, and awarding the associated player a primary award as a function of the outcome, the wager made by the player, and a predetermined paytable, for determining if a triggering conditioning occurred in the primary game and initiating a secondary game, the secondary game including a rotating selector device, a first portion of the rotating selector device being displayed on the first display and a second portion of the rotating selector device being displayed on the second display, the lighting device defining a selector, and, for the secondary game, randomly selecting an outcome of the secondary game, rotating the rotating selector device, the rotating selector device being configured to display a series of symbols in a cycling manner across the first display to the second display such that each symbol moves from the first display to the second display and during the movement from the first display to the second display each symbol appears, in part, on the first display and the second display, controllably stopping the rotating selector device such that a portion of one of the symbols is displayed on the first display and another portion of the one of the symbols is displayed on the second display, the portions of the one of the symbols forming a unified image, the unified image being positioned such that the unified image is overlapped by the selector, the one of the symbols being associated with the outcome of the secondary game, and awarding one or more of the players a secondary award as a function of the outcome of the secondary game.

16. A gaming machine, as set forth in claim 15, wherein the rotating selector device is a reel.

17. A gaming machine, as set forth in claim 15, wherein the rotating selector device is a spinner.

18. A gaming machine, as set forth in claim 15, the secondary game being a progressive game.

19. A gaming machine, as set forth in claim 18, the outcome of the secondary game being one of a set amount and a progressive award.

20. A gaming machine, as set forth in claim 19, the progressive award being one of a plurality of progressive award levels.

21. A gaming machine, as set forth in claim 18, the outcome of the secondary game being one of a set amount, a progressive award, and a number of free spins.

22. A gaming machine, as set forth in claim 15, wherein qualification for the secondary game requires an additional wager.

23. A gaming machine, as set forth in claim 15, the secondary award being a function of a multiplier.

24. A gaming machine, as set forth in claim 15, wherein the primary game is a video slot game.

25. A gaming machine, as set forth in claim 24, the triggering condition being the appearance of one or more triggering symbols in the outcome of the primary game.

26. A gaming machine, as set forth in claim 15, the secondary game including a number of spins of the rotating selector device.

27. A gaming machine, as set forth in claim 26, wherein the number of spins is one of fixed and variable.

28. A gaming machine, comprising:

first and second displays, the first and second displays being adjacent;

a lighting device located between the first and second displays;

a controller coupled to the first and second displays and the lighting device, the controller for allowing an associated player to make a wager on a primary game, randomly selecting an outcome of the primary game, determining if the outcome of the primary game is a winning outcome, and awarding the associated player a primary award as a function of the outcome, the wager made by the player, and a predetermined paytable, for determining if a triggering conditioning occurred in the primary game and initiating a secondary game, the secondary game including a rotating selector device, a first portion of the rotating selector device being displayed on the first display and a second portion of the rotating selector device being displayed on the second display, the lighting device defining a selector, and, for the secondary game, randomly selecting an outcome of the secondary game, rotating the rotating selector device, controllably stopping the rotating selector device such that the selector is associated with a symbol associated with the outcome of the secondary game, and awarding one or more of the players a secondary award as a function of the outcome of the secondary game, the secondary game including a number of spins of the rotating selector device, the triggering condition being the appearance of one or more triggering symbols in the outcome of the primary game, the number of spins of the rotating selector device being equal to the number of triggering symbols.

29. One or more non-transitory computer-readable storage media, having computer-executable instructions embodied thereon, wherein when executed by at least one processor, the computer-executable instructions cause the processor to:

provide a gaming machine including first and second displays and a lighting device located between the first and second displays, the first and second displays being adjacent;

allow an associated player to make a wager on a primary game;

randomly select an outcome of the primary game;

determine if the outcome of the primary game is a winning outcome; and, award the associated player a primary award as a function of the outcome, the wager made by the player, and a predetermined paytable; and, determine if a triggering conditioning occurred in the primary game and initiating a secondary game, the secondary game including a rotating selector device, a first portion of the rotating selector device being displayed on the first display and a second portion of the rotating selector device being displayed on the second display, the lighting device defining a selector, for the secondary game:

randomly select an outcome of the secondary game;

rotate the rotating selector device, the rotating selector device being configured to display a series of symbols in a cycling manner across the first display to the second display such that each symbol moves from the first display to the second display and during the movement from the first display to the second display each symbol appears, in part, on the first display and the second display;

controllably stop the rotating selector device such that a portion of one of the symbols is displayed on the first display and another portion of the one of the symbols is displayed on the second display, the portions of the one of the symbols forming a unified image, the unified image being positioned such that the unified image is overlapped by the selector, the one of the symbols being associated with the outcome of the secondary game; and, award one or more of the players a secondary award as a function of the outcome of the secondary game.

30. One or more non-transitory computer-readable storage media, having computer-executable instructions embodied thereon, wherein when executed by at least one processor, the computer-executable instructions cause the processor to:

provide a gaming machine including first and second displays and a lighting device located between the first and second displays, the first and second displays being adjacent;

allow an associated player to make a wager on a primary game;

randomly select an outcome of the primary game;

determine if the outcome of the primary game is a winning outcome; and, award the associated player a primary award as a function of the outcome, the wager made by the player, and a predetermined paytable; and, determine if a triggering conditioning occurred in the primary game and initiating a secondary game, the secondary game including a rotating selector device, a first portion of the rotating selector device being displayed on the first display and a second portion of the rotating selector device being displayed on the second display, the lighting device defining a selector, for the secondary game:

randomly select an outcome of the secondary game;

rotate the rotating selector device;

controllably stop the rotating selector device such that the selector is associated with a symbol associated with the outcome of the secondary game; and, award one or more of the players a secondary award as a function of the outcome of the secondary game, the secondary game including a number of spins of the rotating selector device, the triggering condition being the appearance of one or more triggering symbols in the outcome of the primary game, the number of spins of the rotating selector device being equal to the number of triggering symbols.

* * * * *